United States Patent [19]

Klimpel et al.

[11] Patent Number: 4,797,202

[45] Date of Patent: Jan. 10, 1989

[54] FROTH FLOTATION METHOD

[75] Inventors: Richard R. Klimpel; Robert D. Hansen, both of Midland, Mich.

[73] Assignee: The Dow Chemical Company, Midland, Mich.

[21] Appl. No.: 19,461

[22] Filed: Feb. 26, 1987

Related U.S. Application Data

[63] Continuation-in-part of Ser. No. 856,728, Apr. 28, 1986, Pat. No. 4,684,459, which is a continuation-in-part of Ser. No. 803,026, Nov. 29, 1985, abandoned, which is a continuation-in-part of Ser. No. 787,199, Oct. 15, 1985, abandoned, which is a continuation-in-part of Ser. No. 649,890, Sep. 13, 1984, abandoned.

[51] Int. Cl.[4] ..... B03D 1/02

[52] U.S. Cl. ..... 209/166; 252/61; 423/26

[58] Field of Search ..... 209/166, 167; 75/2; 252/61; 423/26

[56] References Cited

U.S. PATENT DOCUMENTS

| | | | |
|---|---|---|---|
| 2,120,217 | 6/1938 | Harris | 209/166 |
| 2,177,985 | 10/1939 | Harris | 209/166 |
| 2,387,201 | 10/1945 | Weiner | 260/404.5 |
| 3,006,471 | 10/1961 | Luttinger | 209/166 |
| 3,370,704 | 2/1968 | Baarson et al. . | |
| 3,414,617 | 12/1968 | Bresson et al. . | |
| 3,414,620 | 12/1968 | Bresson et al. . | |
| 3,426,896 | 2/1969 | Baarson et al. . | |
| 3,609,189 | 9/1971 | Bresson et al. . | |
| 3,852,167 | 12/1974 | Gould | 209/166 |
| 3,906,042 | 9/1975 | Bresson et al. | 252/61 |
| 3,975,295 | 8/1976 | Koch | 252/61 |
| 3,985,645 | 10/1976 | Noblitt | 209/166 |
| 4,070,276 | 1/1978 | Broman | 209/166 |
| 4,102,781 | 7/1978 | Tenbergen | 209/166 |
| 4,275,847 | 6/1981 | Bahr et al. | 209/166 |
| 4,295,962 | 10/1981 | Parlman et al. | 207/167 |
| 4,394,257 | 7/1983 | Wang et al. . | |
| 4,482,454 | 11/1984 | DeCuyper | 209/166 |
| 4,676,890 | 6/1987 | Klimpel et al. | 209/166 |
| 4,684,459 | 8/1987 | Klimpel et al. | 209/166 |

FOREIGN PATENT DOCUMENTS

| | | | |
|---|---|---|---|
| 1136073 | 5/1957 | France . | |
| 479493 | 3/1973 | U.S.S.R. | 209/166 |
| 1025452 | 6/1983 | U.S.S.R. | 209/166 |
| 1066655 | 1/1984 | U.S.S.R. | 209/166 |

OTHER PUBLICATIONS

*Issled. Obl. Khim. Vysokomol. Soldin Neftekhim,* 1977 46 (CA92:170103c).

Hackh's Chemical Dictionary p. 341, 4th Edition 1969 McGraw Hill.

*Primary Examiner*—David L. Lacey
*Assistant Examiner*—Thomas M. Lithgow

[57] ABSTRACT

Minerals are recovered from ore by subjecting the ore, in the form of an aqueous pulp, to a froth flotation process in the presence of a collector of the formula:

$$R^1—X—(R)_n—N—(R^2)_2 \quad \text{(Ia)}$$

or $$R^1—X—(R)_n—N=Y \quad \text{(Ib)}$$

wherein $—(R)_n—$ is

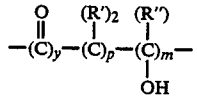

each R′ is independently hydrogen, methyl or ethyl; $y+p+m=n$; n is an integer from 1 to 6; y and m are independently 0 or 1 and $y+m=0$ or 1 and p is an integer from 1 to 6 and each moiety can occur in random sequence; $R^1$ is a $C_{1-22}$ hydrocarbyl or a $C_{1-22}$ substituted hydrocarbyl and each $R^2$ is independently hydrogen, a $C_{1-22}$ hydrocarbyl or a $C_{1-22}$ substituted hydrocarbyl; —X— is $—N(R^3)—$ or

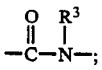

$R^3$ is H or a $C_{1-22}$ hydrocarbyl or a $C_{1-22}$ substituted hydrocarbyl; =Y is =S, =O, a hydrocarbylene or a substituted hydrocarbylene radical.

12 Claims, No Drawings

FROTH FLOTATION METHOD

CROSS-REFERENCE TO RELATED APPLICATIONS

This application is a continuation-in-part of copending application Ser. No. 856,728 filed Apr. 28, 1986 now U.S. Pat. No. 4,684,459 which is a continuation-in-part of copending application Ser. No. 803,026 filed Nov. 29, 1985 now abandoned which is a continuation-in-part of copending application Ser. No. 787,199 filed Oct. 15, 1985 now abandoned which is a continuation-in-part of copending application Ser. No. 649,890, filed Sept. 13, 1984, now abandoned.

BACKGROUND OF THE INVENTION

This invention relates to collectors for the recovery of mineral values from mineral ores by froth flotation.

Flotation is a process of treating a mixture of finely divided mineral solids, e.g., a pulverulent ore, suspended in a liquid whereby a portion of the solids is separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

Various flotation agents have been admixed with the suspension to improve the frothing process. Such added agents are classed according to the function to be performed and include collectors such as xanthates, thionocarbamates and the like; frothers which impart the property of forming a stable froth, e.g., natural oils such as pine oil and eucalyptus oil; modifiers such as activators to induce flotation in the presence of a collector, e.g., copper sulfate; depressants, e.g., sodium cyanide, which tend to prevent a collector from functioning as such on a mineral which it is desired to retain in the liquid, and thereby discourage a substance from being carried up and forming a part of the froth; pH regulators to produce optimum metallurgical results, e.g., lime and soda ash; and the like. The specific additives used in a flotation operation are selected according to the nature of the ore, the mineral sought to be recovered and the other additives which are to be used in combination therewith.

Flotation is employed in a number of mineral separation processes including the selective separation of sulfide and oxide minerals containing metals such as copper, zinc, lead, nickel, molybdenum and the like.

Collectors commonly used for the recovery of metal containing minerals include xanthates, dithiophosphates, and thionocarbamates. Such collectors are widely used in various flotation processes in which metal-containing sulfide minerals are recovered. However, improvements in the recovery rate and/or selectivity of the collectors towards mineral values over the gangue, i.e., the undesired portions of the mineral ore, are always desired. In addition, these collectors do not provide commercially acceptable recovery of metal-containing oxide minerals and of certain metal-containing sulfide minerals such as precious metal-containing sulfide minerals (e.g., gold-containing sulfide minerals).

Of the other collectors, the mercaptan collectors are very slow kinetically in the flotation of metal-containing sulfide mineral and have an offensive odor. The disulfides and polysulfides give relatively low recoveries with slow kinetics. Therefore, the mercaptans, disulfides and polysulfides are not generally used commercially.

In view of the foregoing, a method for froth flotation which is useful in the recovery, at relatively good recovery rates and selectivities towards the mineral values over the gangue, of a broad range of metal values from metal ores, including the recovery of metal-containing sulfide minerals, sulfidized metal-containing oxide minerals and metal-containing oxide minerals, is desired.

SUMMARY OF THE INVENTION

Accordingly, in one aspect, the present invention is a method for recovering a metal-containing mineral from an ore which comprises subjecting the ore, in the form of an aqueous pulp, to a froth flotation process in the presence of a flotation collector under conditions such that the metal-containing mineral(s) are recovered in the froth, wherein the collector comprises a compound corresponding to the formula:

$$R^1—X—(R)_n—N—(R^2)_2 \quad \text{(Ia)}$$

or $$R^1—X—(R)_n—N=Y \quad \text{(Ib)}$$

wherein $—(R)_n—$ is $$—\overset{\overset{\displaystyle O}{\|}}{(C)_y}—\overset{\overset{\displaystyle (R')_2}{|}}{(C)_p}—\overset{\overset{\displaystyle (R'')}{|}}{\underset{\underset{\displaystyle OH}{|}}{(C)_m}}—$$

each R′ and R″ is independently hydrogen, methyl or ethyl; $y+p+m=n$; n is an integer from 1 to 6; y and m are independently 0 or 1 and $y+m=0$ or 1 p is an integer from 1 to 6 and each $$—\overset{\overset{\displaystyle O}{\|}}{(C)_y}—,\ —\overset{\overset{\displaystyle (R)_2}{|}}{(C)_p}— \text{ or } —\overset{\overset{\displaystyle R''}{|}}{\underset{\underset{\displaystyle OH}{|}}{(C)_m}}—$$

moiety of the $—(R)_n—$; group can occur in random sequence; $R^1$ is a $C_{1-22}$ hydrocarbyl or a $C_{1-22}$ substituted hydrocarbyl; each $R^2$ is independently hydrogen, a $C_{1-22}$ hydrocarbyl or a $C_{1-22}$ substituted hydrocarbyl; —X— is $—N(R^3)—$ or $$—\overset{\overset{\displaystyle O}{\|}}{C}—\overset{\overset{\displaystyle R^3}{|}}{N}—$$

(hereinafter represented as (CO)NR3);

$R^3$ is H or a $C_{1-22}$ hydrocarbyl or a $C_{1-22}$ substituted hydrocarbyl; =Y is =S, =O, a hydrocarbylene or a substituted hydrocarbylene radical such as =C=S.

In a preferred embodiment of the present invention, the collector comprises a compound of the formula:

$$R^1—X—(CH_2)_p—N(R^2)_2 \quad (II)$$

wherein $R^1$ is a $C_{1-22}$ hydrocarbyl or a $C_{1-22}$ hydrocarbyl substituted with one or more hydroxy, amino, phosphonyl, or alkoxy groups; one $R^2$ is hydrogen and the other $R^2$ is hydrogen, a $C_{1-6}$ alkyl group, a $C_{1-6}$ alkylcarbonyl, or a $C_{1-6}$ alkyl or $C_{1-6}$ alkylcarbonyl group substituted with an amino, hydroxy or phosphonyl moiety; and —X—, and p are as hereinbefore defined.

The method of the present invention surprisingly floats a broad range of metal-containing minerals including sulfide ores, oxide ores and precious metals. Furthermore, the method gives good recoveries of the mineral values including metal-containing oxide minerals, metal-containing sulfide minerals, and precious metal-containing minerals. Not only are surprisingly high recoveries achieved, but the selectivity towards the desired mineral values is also surprisingly high.

DETAILED DESCRIPTION OF THE INVENTION

Although not specifically set forth in structural formulas (Ia–b), in aqueous medium of low pH, preferably acidic, the collector used in the method of the present invention can exist in the form of a salt. In formulas (Ia–b), $—(R)_n—$ is advantageously:

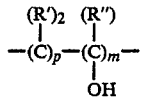

wherein m is 0 or 1 and p is an integer from 1 to 6 and more preferably $—(R)_n—$ is $—(CH_2)_p—$, and p is an integer from 1 to 6, preferably from 1 to 4, most preferably 2 or 3. If either $R^1$ and/or either or both $R^2$ groups are substituted hydrocarbyl groups, they are advantageously substituted with one or more hydroxy, amino, phosphonyl, alkoxy, halo, ether, imino, carbamyl, carbonyl, thiocarbonyl, cyano, carboxyl hydrocarbylthio, hydrocarbyloxy, hydrocarbylamino or hydrocarbylimino groups.

Most advantageously, the carbon atoms in $R^1$ and $R^2$ total 6 or more than $R^1$ is preferably a $C_{2-14}$ hydrocarbyl or a $C_{2-14}$ hydrocarbyl substituted with one or more hydroxy, amino, phosphonyl or alkoxy groups, more preferably a $C_{4-11}$ hydrocarbyl; and one $R^2$ is hydrogen and the other $R^2$ is preferably hydrogen, a $C_{1-6}$ alkyl, a $C_{1-6}$ alkylcarbonyl or a $C_{1-6}$ substituted alkyl or alkylcarbonyl; more preferably hydrogen, a $C_{1-6}$ alkyl, $C_{1-6}$ alkylcarbonyl or a $C_{1-6}$ alkyl or alkylcarbonyl substituted with an amino, hydroxy or phosphonyl group; and most preferably hydrogen, a $C_{1-2}$ alkyl or $C_{1-2}$ alkylcarbonyl. —X— is preferably $—N(R^3)—$. $R^3$ is preferably hydrogen or a $C_{1-14}$ hydrocarbyl, more preferably hydrogen or a $C_{1-11}$ hydrocarbyl, most preferably hydrogen.

The collectors useful in the practice of the present invention include compounds such as the N-(hydrocarbyl)-$\alpha,\omega$-alkanediamines:

$$R^1—(N(R^3))—(CH_2)_n—N—(R^2)_2 \quad (III)$$

and the N-($\omega$-aminoalkyl)hydrocarbon amides:

$$R^1—((CO)N(R^3))—(CH_2)_n—N—(R^2)_2 \quad (IV)$$

wherein $R^1$, $R^2$, $R^3$ and n are as hereinbefore defined. In formulas (III) and (IV), $R^1$ is preferably a $C_{4-10}$ hyrocarbyl. The most preferred class of collectors are the N-(hydrocarbyl)-$\alpha,\omega$-alkanediamines.

The N-(hydrocarbyl)-$\alpha,\omega$-alkanediamines can be prepared by the process well-known in the art, one example is the process described in East German Pat. No. 98,510 (incorporated herein by reference). The N-($\omega$-aminoalkyl)hydrocarbon amides can be prepared by the processes described in U.S. Pat. No. 4,326,067 to Fazio (relevant parts incorporated herein by reference); *Acta Polon Pharm,* 19, 277 (1962) (incorporated herein by reference); and *Beilstein,* 4, 4th Ed., 3rd Supp., 587 (1962) (incorporated herein by reference).

The method of the present invention is useful for the recovery by froth flotation of metal-containing minerals from ores. An ore refers herein to the metal as it is taken out of the ground and includes the metal-containing minerals in admixture with the gangue. Gangue refers herein to those materials which are of no value and need to be separated from the metal values. The method of the present invention can be used to recover metal oxides, metal sulfides and other metal values.

Ores for which the collector and process are useful include the sulfide mineral ores containing copper, zinc, molybdenum, cobalt, nickel, lead, arsenic, silver, chromium, gold, platinum, uranium and mixtures thereof. Examples of metal-containing sulfide minerals which may be concentrated by froth flotation using the method of this invention include copper-bearing minerals such as covellite ($CuS$), chalcocite ($Cu_2S$), chalcopyrite ($CuFeS_2$), valleriite ($Cu_2Fe_4S_7$ or $Cu_3Fe_4S_7$), tetrahedrite ($Cu_3SbS_2$), bornite ($Cu_5FeS_4$), cubanite ($Cu_2SFe_4S_5$), enargite ($Cu_3(As_2Sb)S_4$), tennantite ($Cu_{12}As_4S_{13}$), brochantite ($Cu_4(OH)_6SO_4$), antlerite ($Cu_3SO_4(OH)_4$), famatinite ($Cu_3(SbAs)S_4$), and bournonite ($PbCuSbS_3$); lead-bearing minerals such as galena ($PbS$); antimony-bearing minerals such as stibnite ($Sb_2S_3$); zinc-bearing minerals such as sphalerite ($ZnS$); silver-bearing minerals such as stephanite ($Ag_5SbS_4$), and argentite ($Ag_2S$); chromium-bearing minerals such as daubreelite ($FeSCrS_3$); nickel-bearing minerals such as pentlandite [$(FeNi)_9S_8$]; molybdenumbearing minerals such as molybdenite ($MoS_2$); and platinum- and palladium-bearing minerals such as cooperite ($Pt(AsS)_2$). Preferred metal-containing sulfide minerals include molybdenite ($MoS_2$), chalcopyrite ($CuFeS_2$), galena ($PbS$), sphalerite ($ZnS$), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics, so the minerals can be recovered in froth flotation using collectors which recover sulfide minerals. Sulfidization results in oxide minerals having sulfide mineral characteristics. Oxide minerals are sulfidized by contact with compounds which react with the minerals to form a sulfur bond or affinity. Such methods are well-known in the art. Such compounds include sodium hydrosulfide, sulfuric acid and related sulfur-containing salts such as sodium sulfide.

Sulfidized metal-containing oxide minerals and oxide minerals for which the method of the present invention is useful include oxide minerals containing copper, aluminum, iron, magnesium, chromium, tungsten, molybdenum, titanium, manganese, tin, uranium and mixtures thereof. Examples of metal-containing minerals which may be concentrated by froth flotation using the process of this invention include copper-bearing minerals such as cuprite ($Cu_2O$), tenorite (CuO), malachite ($Cu_2(OH)_2CO_3$), azurite ($Cu_3(OH)_2(CO_3)_2$), atacamite ($Cu_2Cl(OH)_3$), chrysocolla ($CuSiO_3$); aluminum-bearing minerals such as corundum; zinc-containing minerals such as zincite (ZnO) and smithsonite ($ZnCO_3$); tungsten-containing minerals such as wolframite [(Fe, Mn)$WO_4$]; nickel-bearing minerals such as bunsenite (NiO); molybdenum-bearing minerals such as wulfenite ($PbMoO_4$) and powellite ($CaMoO_4$); iron-containing minerals such as hematite and magnetite; chromium-containing minerals; iron- and titanium-containing minerals such as ilmenite; magnesium- and aluminum-containing minerals such as spinel; iron-chromium-containing minerals such as chromite ($FeOCr_2O_3$); titanium-containing minerals such as rutile; manganese-containing minerals such as pyrolusite; tin-containing minerals such as cassiterite; and uranium-containing minerals such as uraninite, pitchblende ($U_2O_5(U_3O_8)$) and gummite ($UO_3nH_2O$).

Other metal-containing minerals for which the method of the present invention is useful include gold-bearing minerals such as sylvanite ($AuAgTe_2$) and calaverite (AuTe); platinum- and palladium-bearing minerals, such as sperrylite ($PtAs_2$); and silver-bearing minerals, such as hessite ($AgTe_2$). Also included are metals which occur in a metallic state, e.g., gold, silver and copper.

In a preferred embodiment of this invention, oxide- or sulfide-containing values are recovered. In a more preferred embodiment, copper-containing sulfide minerals, nickel-containing sulfide minerals, lead-containing sulfide minerals, zinc-containing sulfide minerals or molybdenum-containing sulfide minerals are recovered. In an even more preferred embodiment, a copper-containing sulfide mineral is recovered.

The collectors can be used in any concentration which gives the desired recovery of the desired metal values. In particular, the concentration used is dependent upon the particular mineral to be recovered, the grade of the ore to be subjected to the froth flotation process, and the desired quality of the mineral to be recovered. Preferably, the collectors of this invention are used in concentrations of 5 grams (g) to 1000 g per metric ton of ore, more preferably between about 10 g and 200 g of collector per metric ton of ore to be subjected to froth flotation. In general, to obtain optimum performance from the collector, it is most advantageous to begin at low dosage levels and increase the dosage level until the desired effect is achieved.

During the froth flotation process of this invention, the use of frothers is preferred. Frothers are well-known in the art and reference is made thereto for the purposes of this invention. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates and the like. Furthermore, blends of such frothers may also be used. Frothers useful in this invention include any frother known in the art which give the recovery of the desired mineral.

In addition, in the process of the present invention it is contemplated that two or more collectors as hereinbefore described can be employed or that one or more collector as hereinbefore described can be employed with one or more other collector.

Collectors, known in the art, which may be used in admixture with the collectors of this invention are those which will give the desired recovery of the desired mineral value. Examples of collectors useful in this invention include alkyl monothiocarbonates, alkyl dithiocarbonates, alkyl trithiocarbonates, dialkyl dithiocarbamates, alkyl thionocarbamates, dialkyl thioureas, monoalkyl dithiophosphates, dialkyl and diaryl dithiophosphates, dialkyl monothiophosphates, thiophosphonyl chlorides, dialkyl and diaryl dithiophosphonates, alkyl mercaptans, xanthogen formates, xanthate esters, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, and guanidine.

The following examples are included for illustration and do not limit the scope of the invention or claims. Unless otherwise indicated, all parts and percentages are by weight.

In the following examples, the performance of the frothing processes described is shown by giving the rate constant of flotation and the amount of recovery at infinite time. These numbers are calculated by using the formula:

$$r=R_\infty[1-(1-e^{-Kt})/Kt]$$

wherein: r is the amount of mineral recovered at time t, K is the rate constant for the rate of recovery and $R_\infty$ is the calculated amount of the mineral which would be recovered at infinite time. The amount recovered at various times is determined experimentally and the series of values are substituted into the equation to obtain the $R_\infty$ and K. The above formula is explained in Klimpel, "Selection of Chemical Reagents for Flotation", Chapter 45, pp. 907–934, *Mineral Processing Plant Design,* 2nd Ed., 1980, AIME (Denver) (incorporated herein by reference).

EXAMPLE 1

Froth Flotation of Copper Sulfide

In this example, several of the collectors of this invention are tested for flotation of copper-containing sulfide minerals. A 500-g quantity of Chilean copper-containing ore comprising chalcopyrite, previously packaged, is placed in a rod mill with 257 g of deionized water. A quantity of lime is also added to the rod mill, based on the desired pH for the subsequent flotation. The rod mill is then rotated at 60 rpm for a total of 360 revolutions. After milling, the ore has a particle size such that 80.2 percent of the particles are less than about 75 micrometers. The ground slurry is transferred to a 1500-ml cell of an Agitair Flotation machine. The float cell is agitated at 1150 rpm and the pH is adjusted to 10.5 by the addition of further lime, if necessary.

The collector is added to the float cell (50 g/metric ton), followed by a conditioning time of one minute, at which time the frother, DOWFROTH®250 (trademark of The Dow Chemical Company), is added (40 g/metric ton). After the additional one-minute conditioning time, the air to the float cell is turned on at a rate of 4.5 liters per minute and the automatic froth removal paddle is started. The froth samples are taken off at 0.5, 1.5, 3, 5 and 8 minutes. The froth samples are dried overnight in an oven, along with the flotation tailings.

The dried samples are weighed, divided into suitable samples for analysis, pulverized to insure suitable fineness, and dissolved in acid for analysis. The samples are analyzed using a DC Plasma Spectrograph. The results are compiled in Table I.

The collectors that were tested for flotation of the copper-containing mineral are set forth in Table I and demonstrate that the method of the present invention is effective in the recovery of copper-containing mineral. It should be noted that the collectors were not selected for optimum performance but represent an arbitrary selection.

TABLE I

Collectors of the Class $R^1-(NR^3)-(CH_2)_2-N(R^2)(H)$

| | | | Cu | | Gangue | | Cu | Gangue | |
|---|---|---|---|---|---|---|---|---|---|
| | | | K | $R_\infty$ | K | $R_\infty$ | R-8① | R-8① | Selectivity② |
| $R^1$ | $R^2$ | $R^3$ | | | | | | | |
| butyl | hydrogen | butyl | 4.61 | 0.628 | 3.12 | 0.056 | 0.622 | 0.057 | 10.9 |
| butyl | ethylcarbonyl | butyl | 4.16 | 0.443 | 3.31 | 0.084 | 0.428 | 0.081 | 5.3 |
| ethyl | hydrogen | ethyl | 3.55 | 0.488 | 3.37 | 0.056 | 0.475 | 0.056 | 8.5 |
| ethylcarbonyl | hydrogen | hydrogen | 2.15 | 0.298 | 3.57 | 0.053 | 0.284 | 0.052 | 5.5 |
| heptylcarbonyl | hydrogen | hydrogen | 5.66 | 0.636 | 3.68 | 0.095 | 0.630 | 0.094 | 6.7 |
| hexyl | hydrogen | hexyl | 3.52 | 0.608 | 2.37 | 0.069 | 0.587 | 0.067 | 8.8 |
| hexyl | ethylcarbonyl | hexyl | 1.54 | 0.438 | 1.06 | 0.080 | 0.394 | 0.068 | 5.8 |
| heptylcarbonyl | hydrogen | hydrogen | 4.32 | 0.532 | 2.33 | 0.099 | 0.523 | 0.097 | 5.4 |
| nonylcarbonyl | hydrogen | hydrogen | 5.22 | 0.669 | 3.06 | 0.091 | 0.654 | 0.089 | 7.3 |
| $H_9C_4OCH_2CH(OH)CH_2-$ | hydrogen | hydrogen | 4.81 | 0.381 | 3.94 | 0.058 | 0.381 | 0.057 | 6.7 |
| $H_9C_4CH(C_2H_5)CH_2-O-CH_2CH(OH)C_2H_4-$ | hydrogen | hydrogen | 3.06 | 0.438 | 2.82 | 0.062 | 0.422 | 0.061 | 7.0 |
| $H_9C_4CH(C_2H_5)CH_2CH(OH)CH_2NHC_3H_6-$ | hydrogen | hydrogen | 3.41 | 0.463 | 2.79 | 0.059 | 0.490 | 0.058 | 7.8 |
| Collector | | | | | | | | | |
| 3-(N,N—dimethyl)aminopropylamidoheptane | 4.02 | 0.455 | 2.71 | 0.086 | 0.439 | 0.083 | 5.3 | | |
| (1,2-ethanediyl(nitrilobis(methylene)))tetrakis phosphonic acid | 2.68 | 0.318 | 2.74 | 0.076 | 0.306 | 0.072 | 4.2 | | |
| No collector③ | 2.63 | 0.298 | 3.20 | 0.060 | 0.289 | 0.098 | 4.9 | | |

① R-8 is experimental recovery after 8 minutes
② Selectivity is calculated as the copper recovery at 8 minutes divided by the gangue recovery at 8 minutes
③ Not an example of the present invention.

EXAMPLE 2

A central Canadian sulfide ore containing copper, nickel, platinum, palladium and gold metal values is subjected to a series of froth flotations as described in Example 1 using the method of this invention and methods known in the art. The frother used is DOWFROTH®1263 (trademark of The Dow Chemical Company) at a concentration of 0.00625 lb/ton of ore (3.12 g/metric ton of ore). The collectors are used at a concentration of 0.0625 lg/ton of ore (31.2 g/metric ton of ore). The froths produced are recovered at 0.5, 1.0, 2.0, 4.0, 7.0, 11.0 and 16.0 minutes. The results are compiled in Table II.

TABLE II

| | Copper | | | | Nickel | | | | Pyrrhotite | | | Tailing③ | | |
|---|---|---|---|---|---|---|---|---|---|---|---|---|---|---|
| Collector | K | R-4① | R-16② | $R_\infty$ | K | R-4① | R-16② | $R_\infty$ | K | R-16② | $R_\infty$ | Pt | Pd | Au |
| Sodium amyl xanthate* | 5.4 | .883 | .934 | .932 | 1.39 | .696 | .855 | .876 | 0.49 | 0.275 | .302 | .0110 | .0112 | .0054 |
| Z-211④* | 4.7 | .931 | .958 | 1.00 | 0.87 | .760 | .889 | .990 | 0.25 | 0.496 | .612 | .0071 | .0100 | .0049 |
| Aerofloat 3477⑤* | 6.4 | .909 | .942 | .949 | 1.31 | .245 | .325 | .323 | 1.02 | 0.185 | .177 | .0139 | .0116 | .0054 |
| NOPA⑥ | 4.4 | .816 | .887 | .879 | 1.81 | .637 | .799 | .789 | 0.66 | 0.199 | .198 | .0117 | .0124 | .0064 |

*Not an embodiment of this invention
① Recovery after 4 minutes
② Recovery after 16 minutes
③ Ounces per metric ton - tailings represent amount of unrecovered metal contained in unfloated gangue material
④ Trademark of The Dow Chemical Company - thionocarbamate
⑤ Trademark of American Cyanamide - dithiophosphate
⑥ NOPA is 3-(nonyloxy)propylamine Table II illustrates the method of the present invention using NOPA as a collector as compared to three methods uisng a conventional collector optimized for commercial use. The ore was complex containing various metal values. The method of the present invention is comparable with known methods in the recovery of copper and nickel values. The method using the NOPA collector gives superior performance in the reduction of R-16 pyrrhotite values when compared against the method using the conventional collectors. The ratio of nickel recovery to pyrrhotite recovery is clearly superior when compared to known collectors, i.e., a 30 percent increase in ratio.

EXAMPLE 3

Froth Flotaton of Copper Sulfide

In this example, several of the collectors of this invention are tested for flotation of copper sulfide values. A 500-gram quantity of Western Canada copper ore, a relatively high grade chalcopyrite copper sulfide ore with little pyrite, is placed in a rod mill having 1-inch rods, with 257 g of deionized water and ground for 420 revolutions at a speed of 60 rpm to produce a size distribution of 25 percent less than 100 mesh. A quantity of lime is also added to the rod mill, based on the desired pH for the subsequent flotation. The ground slurry is transferred to a 1500-ml cell of an Agitair® Flotation machine. The float cell is agitated at 1150 rpm and the pH is adjusted to 8.5 by the addition of further lime.

The collector is added to the float cell at the rate of 8 g/metric ton, followed by a conditioning time of 1 minute, at which time the frother, DOWFROTH®250 (Trademark of The Dow Chemical Company), is added at the rate of 18 g/metric ton. After the additional 1-minute conditioning time, the air to the float cell is turned on at a rate of 4.5 liters per minute and the automatic froth removal paddle is started. The froth samples are taken off at 0.5, 1.5, 3, 5 and 8 minutes. The froth samples are dried overnight in an oven, along with the flotation tailings. The dried samples are weighed, divided into suitable samples for analysis, pulverized to insure suitable fineness, and dissolved in acid for analysis. The samples are analyzed using a DC Plasma Spectrograph. The results are compiled in Table III. The compounds that are used in Samples 1 through 5 in Table III are separately listed below:

1.—No collector (Not an example of the present invention)

2.—$(C_4H_9)_2N(CH_2)_2NH_2$

3.—$C_9H_{19}((CO)NH)(CH_2)_2NH_2$

4.—$C_4H_9(COO)C_2H_4NH(CH_2)_2NH_2$

5.—$CH_3NH(CH_2)_2N(CH_3)CH_2CH(OH))-H_2OCH_2CH(C_2H_5)C_4H_9$

TABLE III

| Example No. | Copper K | Copper R∞ | Gangue K | Gangue R∞ | Copper R-8 | Gangue R-8 | Selectivity |
|---|---|---|---|---|---|---|---|
| 1 | 2.11 | 0.306 | 1.61 | 0.068 | 0.291 | 0.066 | 4.4 |
| 2 | 2.04 | 0.382 | 1.88 | 0.0735 | 0.358 | 0.0692 | 5.2 |
| 3 | 2.36 | 0.435 | 2.15 | 0.0858 | 0.409 | 0.0815 | 5.0 |
| 4 | 2.14 | 0.367 | 1.61 | 0.080 | 0.345 | 0.075 | 4.6 |
| 5 | 2.35 | 0.340 | 2.14 | 0.0702 | 0.324 | 0.0676 | 4.8 |

Example 3 is similar to Example 1 except that various different compounds within the scope of the invention were tested on a different copper sulfide ore. No optimization of the collectors was attempted but all of the compounds were found to be superior when compared against "no collector" in the recovery of copper values.

EXAMPLE 4

Froth Flotation of a Nickel/Cobalt Ore from Western Australia

A series of 750-g charges of a nickel/cobalt ore are prepared in slurry form (30 percent solids). The flotation cell is an Agitair® LA-500 outfitted with an automatic paddle for froth removal operating at 10 rpm's. A standard run is to first add 0.2 kg/metric ton of $CuSO_4$, condition for 3 minutes, add 0.14 kg/ton guar depressant for talc and 0.16 kg/metric ton collector, and subsequently add a frother (e.g., triethoxybutane) to form a reasonable froth bed. Concentrate collection is initiated for 5 minutes (denoted as rougher concentrate). Then 0.16 kg/metric ton collector plus 0.07 kg/metric ton guar is added to remaining cell contents along with whatever frother is necessary and concentrate collection is initiated for 9 minutes (denoted as middlings) with the remaining cell contents denoted as flotation tails. After this, the rougher concentrate is transferred to a smaller cell, 0.08 kg collector/metric ton of ore plus 0.14 kg guar/metric ton of ore is added to the cell with no frother, concentrate collection is initiated for 3 minutes (denoted as cleaner concentrate) with the cell contents denoted as cleaner tails. Samples are filtered, dried, and assayed using X-ray analysis methodology. Recoveries are calculated using standard metallurgical procedures. The results of this test are compiled in Table IV. The compounds used as collectors in the Samples 1 to 3 are:

Collector 1—Sodium ethyl xanthate (Not an example of this invention)

Collector 2—$(C_4H_9)_2N(CH_2)_2NH_2$

Collector 3—$C_7H_{15}((CO)NH)(CH_2)_2NH_2$

TABLE IV

| | Nickel/Cobalt Ore from Western Australia | | | | | | | |
|---|---|---|---|---|---|---|---|---|
| | Percent Nickel Recovery | | | | Percent Cobalt Recovery | | | |
| Collector | Cleaner Conc. | Flotation Tail | Cleaner Tail | Middlings | Cleaner Conc. | Flotation Tail | Cleaner Tail | Middlings |
| 1* | 62.4 | 7.3 | 24.9 | 5.4 | 66.9 | 12.0 | 16.7 | 4.4 |
| 2 | 57.1 | 4.0 | 9.3 | 29.6 | 65.1 | 7.3 | 7.3 | 20.3 |
| 3 | 56.0 | 1.4 | 12.3 | 30.3 | 62.4 | 3.0 | 8.5 | 26.2 |

*Not an example of the invention

The data in Table IV represents a full scale simulation of a continuous industrial flotation process. The data in the column entitled "Flotation Tail" is the most significant data since it shows actual metal loss, i.e., the lower the value in the Flotation Tail column, the lower the loss of metal containing ores. The superiority of the experimental collectors of the invention over the industrial standard in this category is apparent. The Flotation Tail for both nickel and cobalt using the method of the present invention was considerable below the method using a standard commercial collector which indicates much higher over-all metal recoveries using the method of the present invention.

What is claimed is:

1. A method of recovering metal-containing sulfide minerals, sulfidized metal-containing oxide minerals, precious metal containing minerals, nickel-bearing oxide minerals or copper-bearing oxide minerals from a metal ore which comprises subjecting the metal ore, in the form of an aqueous pulp, to a froth flotation process in the presence of a flotating amount of a flotation collector under conditions such that the metal-containing sulfide mineral, sulfidized metal-containing oxide mineral, precious metal containing mineral, nickel-bearing oxide mineral or copper-bearing oxide mineral is recovered in the froth, wherein the collector comprises a compound corresponding to the formula:

$$R^1—X—(R)_n—N—(R^2)_2$$

wherein $—(R)_n—$ is

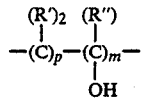

each R′ and R″ is independently hydrogen, methyl or ethyl; p+m=n; n is an integer from 1 to 6; m is independently 0 or 1, and p is an integer from 1 to 6 and each

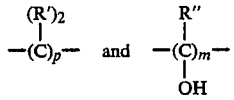

moiety of the $-(R)_n-$ group can occur in random sequence; $R^1$ is a $C_{1-22}$ hydrocarbyl or a $C_{1-22}$ substituted hydrocarbyl; one $R^2$ is hydrogen or a $C_{1-22}$ hydrocarbyl and one $R^2$ is hydrogen, $C_{1-22}$ hydrocarbyl or a $C_{1-22}$ substituted hydrocarbyl; —X— is $N(R^3)$— or

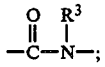

$R^3$ is H or a $C_{1-22}$ hydrocarbyl or a $C_{1-22}$ substituted hydrocarbyl and recovering said mineral or minerals from said froth.

2. The method of claim 1 wherein the carbon atoms in $R^1$ and $R^2$ total 6 or more; $R^1$ is $C_{2-14}$ hydrocarbyl or a $C_{2-14}$ hydrocarbyl substituted with one or more hydroxy, amino, ether or alkoxy groups; one $R^2$ is hydrogen and the other $R^2$ is hydrogen, a $C_{1-6}$ alkyl, $C_{1-6}$ alkylcarbonyl, or a $C_{1-6}$ alkyl or alkylcarbonyl substituted with an amino, hydroxy or ether group and n is an integer of from 1 to 4; and $R^3$ is hydrogen or a $C_{1-14}$ hydrocarbyl.

3. The method of claim 2 wherein $-(R)_n-$ is $-(CH_2)p-$, and p is an integer from 1 to 6.

4. The method of claim 3 wherein p is an integer from 1 to 4; $R^1$ is a $C_{4-11}$ hydrocarbyl, one $R^2$ hydrogen and the other $R^2$ is hydrogen, a $C_{1-6}$ alkyl or $C_{1-6}$ alkylcarbonyl and $R^3$ is hydrogen or a $C_{1-11}$ hydrocarbyl.

5. The method of claim 4 wherein one $R^2$ is hydrogen, the other $R^2$ is hydrogen, a $C_{1-2}$ alkyl or $C_{1-2}$ alkylcarbonyl, p is 2 or 3 and $R^3$ is hydrogen.

6. The method of claim 2 wherein —X— is $-N(R^3)-$.

7. The method of claim 2 wherein the collector is employed in an amount of between about 5 and 250 grams per metric ton of ore.

8. The method of claim 7 wherein the mineral or minerals recovered is a metal-containing sulfide mineral.

9. The method of claim 8 wherein the mineral or minerals recovered is a copper-containing sulfide mineral, a nickel-containing sulfide mineral, a lead-containing sulfide mineral, a zinc-containing sulfide mineral or a molybdenum-containing sulfide mineral.

10. The method of claim 1 wherein the collector corresponds to the formula:

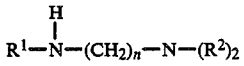

wherein $R^1$ is a $C_{2-14}$ hydrocarbyl or a $C_{2-14}$ hydrocarbyl substituted with one or more hydroxy, amino, phosphonyl or alkoxy groups; one $R^2$ is hydrogen and the other $R^2$ is hydrogen, a $C_{1-6}$ alkyl, a $C_{1-6}$ alkylcarbonyl, or a $C_{1-6}$ alkyl or $C_{1-6}$ alkylcarbonyl substituted with an amino, hydroxy or ether group.

11. The method of claim 10 wherein the aqueous pulp further comprises a frother.

12. The method of claim 11 wherein the frother is a $C_{5-8}$ alcohol, pine oil, cresol, a $C_{1-4}$ alkkyl ether of polypropylene glycol, a dihydroxylate of polypropylene glycol, glycol, a fatty acid, a soap or an alkylaryl sulfonate.

* * * * *